US009234340B2

(12) United States Patent
Hong et al.

(10) Patent No.: US 9,234,340 B2
(45) Date of Patent: Jan. 12, 2016

(54) MOUNTING ASSEMBLY FOR A TOILET

(71) Applicant: Globe Union Industrial Corp., Taichung (TW)

(72) Inventors: Chu-Wan Hong, Taichung (TW); Chung-Yu Kuo, Taichung (TW); Ming-Chia Wu, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 195 days.

(21) Appl. No.: 13/913,450

(22) Filed: Jun. 9, 2013

(65) Prior Publication Data

US 2014/0359927 A1 Dec. 11, 2014

(51) Int. Cl.
*E03D 11/00* (2006.01)
*E03D 11/16* (2006.01)

(52) U.S. Cl.
CPC ..... *E03D 11/16* (2013.01)

(58) Field of Classification Search
CPC ..... E03D 11/13; E03D 11/135; E03D 11/16; E03D 11/17; E03C 1/20
USPC ..... 4/252.1, 252.4, 252.5, 252.6; 285/56, 285/58, 59, 60
See application file for complete search history.

(56) References Cited

U.S. PATENT DOCUMENTS

| | | | | | |
|---|---|---|---|---|---|
| 519,878 | A * | 5/1894 | Stevens | 4/429 |
| 1,533,444 | A * | 4/1925 | Mohr | 4/252.1 |
| 2,479,837 | A * | 8/1949 | Hollaender | 285/60 |
| 4,780,915 | A * | 11/1988 | Cuschera | 4/252.4 |
| 5,246,255 | A * | 9/1993 | Forbes et al. | 285/24 |
| 5,309,579 | A * | 5/1994 | Nelson | 4/252.1 |
| 5,335,849 | A * | 8/1994 | Forbes | 285/12 |
| 5,421,036 | A | 6/1995 | Stevens et al. | |
| 6,065,160 | A | 5/2000 | Winn | |
| 6,292,956 | B1 * | 9/2001 | Kayahara | 4/420 |
| 6,634,034 | B2 | 10/2003 | Rendell | |
| 8,281,421 | B2 | 10/2012 | Hughes | |
| 8,561,218 | B1 * | 10/2013 | Arce | 4/252.4 |
| 2013/0219603 | A1 * | 8/2013 | Wendorff | 4/252.4 |

FOREIGN PATENT DOCUMENTS

| | | | | |
|---|---|---|---|---|
| JP | 05140978 | A * | 6/1993 | E03D 11/16 |

* cited by examiner

*Primary Examiner* — Lauren Crane
*Assistant Examiner* — Erin Deery
(74) *Attorney, Agent, or Firm* — Alan D. Kamrath; Kamrath IP Lawfirm, P.A.

(57) ABSTRACT

A mounting assembly contains a plate including a first fringe, a second fringe, a third fringe, and a fourth fringe. The first fringe has a first raised portion, and the second fringe has a semi-circular groove. The plate includes a plurality of first adjusting apertures, at least one pair of second adjusting apertures, and at least one pair of third adjusting apertures. The at least one pair of third adjusting apertures is defined between the at least one pair of second adjusting apertures, a distance between the at least one pair of second adjusting apertures is equal to that of two opposite orifices, two supporting members are symmetrically connected with the third fringe and the fourth fringe, and each supporting member has a plurality of first eyelets so that the first bolt inserts through the through hole to screw with one of the plurality of first eyelets.

8 Claims, 11 Drawing Sheets

MOUNTING ASSEMBLY FOR A TOILET

FIELD OF THE INVENTION

The present invention relates to a mounting assembly for a toilet.

BACKGROUND OF THE INVENTION

A conventional mounting assembly is applied to fix a toilet on a floor of a building as disclosed in U.S. Pat. Nos. 5,421,036, 6,065,160, 6,634,034 and 8,281,421.

With reference to FIG. 1, a toilet flange is connected with an outlet tube via a connecting tube and fixed on the floor, thereafter a wax ring is sealed a gap between the toilet flange and a bottom end of the toilet, and a conventional toilet 1 has two saddle portions 2, each having a fixing hole 3. In addition, the toilet 1 is mounted on the toilet flange 5 by ways of a bolt 4.

As shown in FIG. 2, another toilet 6 cannot be fixed on the toilet flange 5 by using a bolt. Referring further to FIGS. 3 and 4, a conventional mounting assembly for a toilet contains two L-shaped supporting members 7, and each having a horizontal extension 7*a* on which a fixing hole 7*b* is defined, such that a first bolt 5*a* on the toilet is inserted into the fixing hole 7*b* so as to screw with a nut 5*b*, thus fixing the two supporting members 7 on the two sides of the toilet flange 5, the each supporting member 7*c* has a plurality of first orifices 7*d* relative to a respective one of two second orifices 6*b* of two longitudinal fences 6*a* of two sides of the toilet 6. As illustrated in FIG. 2, a second bolt 8 is inserted through the respective one of the two second orifices 6*b* to screw with a respective one of the plurality of first orifices 7*d*, such that the toilet 6 is fixed on the toilet flange 5 by means of the two supporting members 7.

However, the outlet of the conventional toilet offsets forwardly or backwardly, the outlet tube of the floor offsets forwardly or backwardly, and a connecting portion of the each supporting member 7 and the toilet 6 offsets forwardly or backwardly as well, so when the toilet 6 does not contact with the floor flatly, thereby using the toilet discomfortably and insecurely.

The present invention has arisen to mitigate and/or obviate the afore-described disadvantages.

SUMMARY OF THE INVENTION

The primary object of the present invention is to provide a mounting assembly for a toilet which is capable of overcoming the shortcomings of the conventional mounting assembly for a toilet.

To obtain the above objectives, a mounting assembly is used to fix a toilet on a toilet flange; the toilet includes two longitudinal fences defined on two sides thereof, and each longitudinal fence has a through hole formed thereon so as to insert a first bolt; the toilet flange includes a tube and a circular rim arranged around a top surface of the tube; the circular rim has at least four orifices and at least two arcuate slots; each orifice is served to insert a flange bolt, and then the flange bolt is fixed on a floor of a building; each arcuate slot is applied to downwardly slide and retain with a head end of a respective one of at least one second bolt, and an extension of a respective one second bolt extends out of the each arcuate slot upwardly.

The mounting assembly contains:

a plate including a first fringe defined on a front side thereof, a second fringe formed on a rear side thereof, a third fringe arranged on a left side thereof, and a fourth fringe defined on a right side thereof; the first fringe having a first raised portion bending downwardly therefrom so that the plate abuts against the toilet flange, the first raised portion contacts with the floor; the second fringe having a semi-circular groove defined on a middle section thereof so that the plate does not shield an inlet of the tube of the toilet flange by ways of the semi-circular groove; the plate including a plurality of first adjusting apertures adjacent to the third fringe and the fourth fringe, such that the respective one second bolt is alternatively inserted through a respective one first adjusting aperture so as to screw with a respective one of the at least one nut, thus fixing the plate on the toilet flange; the plate also including at least one pair of second adjusting aperture and at least one pair of third adjusting aperture defined between the plurality of first adjusting apertures and proximate to the first fringe; each second adjusting aperture and each third adjusting aperture being elongated, and the at least one pair of third adjusting aperture being defined between the at least one pair of second adjusting aperture; a distance between the at least one pair of second adjusting aperture being equal to that of two opposite orifices so that two flanged bolts are removed from the two opposite orifices and are locked on the floor via the at least one pair of second adjusting aperture, hence the plate is fixed on the toilet flange; when the toilet flange is made of plastic material, two third bolts are screwed with the circular rim via the at least one pair of third adjusting aperture, such that the plate is fixed on the toilet flange; thereby, the plurality of first adjusting apertures match with the at least one second bolt to fix the plate on the toilet flange based on using requirement, or the at least one pair of second adjusting aperture cooperates with the two flanged bolts to fix the plate on the toilet flange; or the at least one pair of third adjusting aperture mates with the two third bolts so as to fix the plate on the toilet flange;

two supporting members symmetrically connected with the third fringe and the fourth fringe, and each supporting member having a plurality of first eyelets so that the first bolt inserts through the through hole of the each longitudinal fence to screw with one of the plurality of first eyelets, hence the toilet is fixed on the toilet flange via the mounting assembly.

DETAILED DESCRIPTION OF THE PREFERRED EMBODIMENTS

Figure 1:
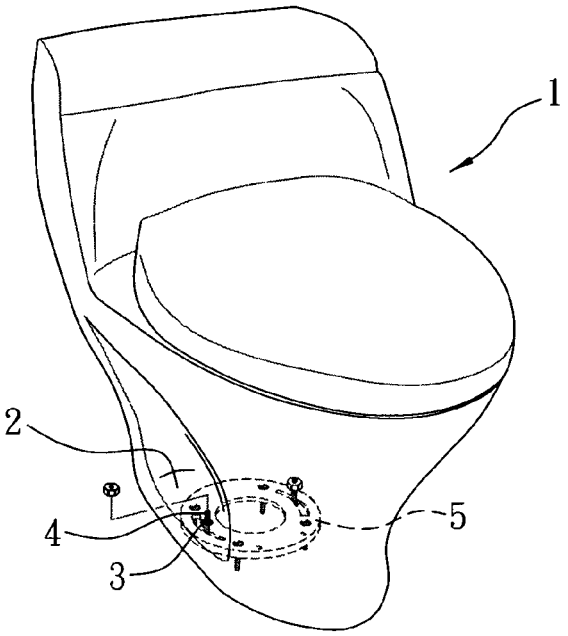
FIG. 1 Prior Art
FIG. 1 is a perspective view of a conventional toilet.
Figure 2:
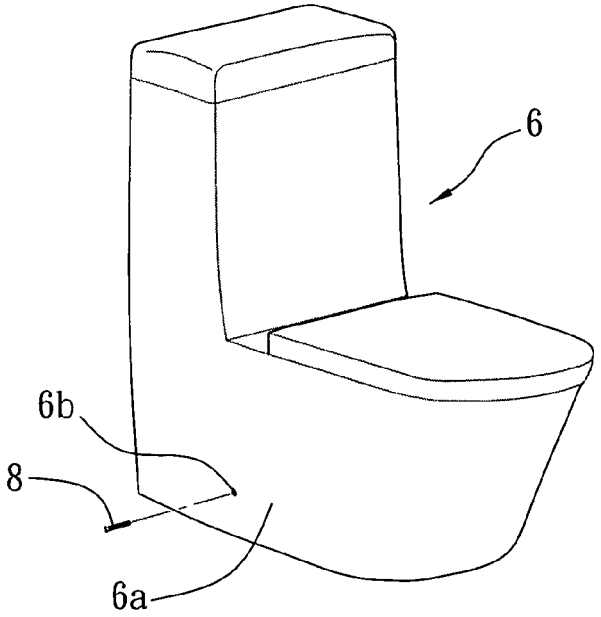
FIG. 2 Prior Art
FIG. 2 is a perspective view of another conventional toilet.
Figure 3:
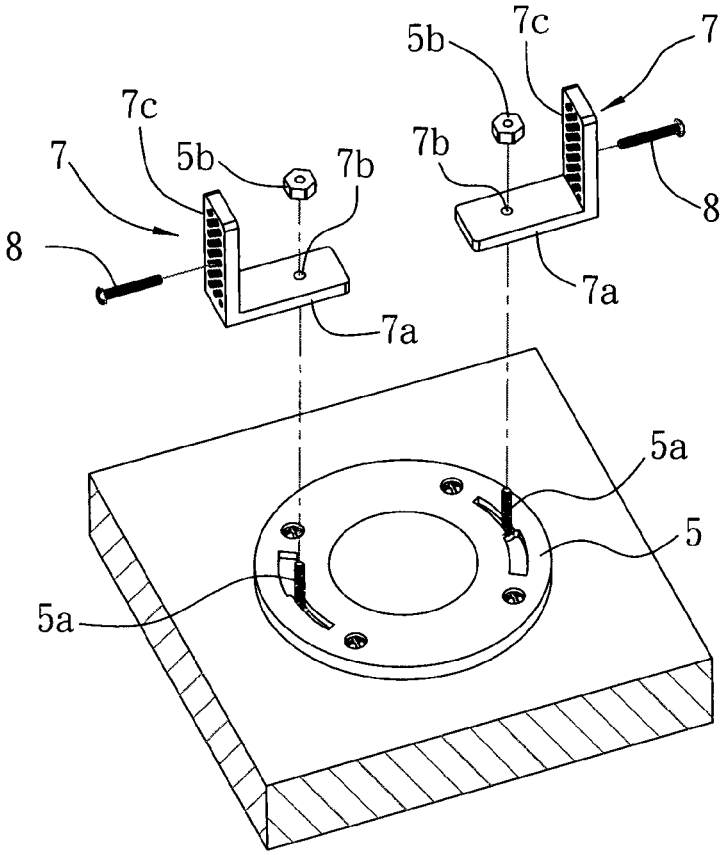
FIG. 3 Prior Art
FIG. 3 is a perspective view showing the exploded components of a conventional mounting assembly for the conventional toilet.
Figure 4:
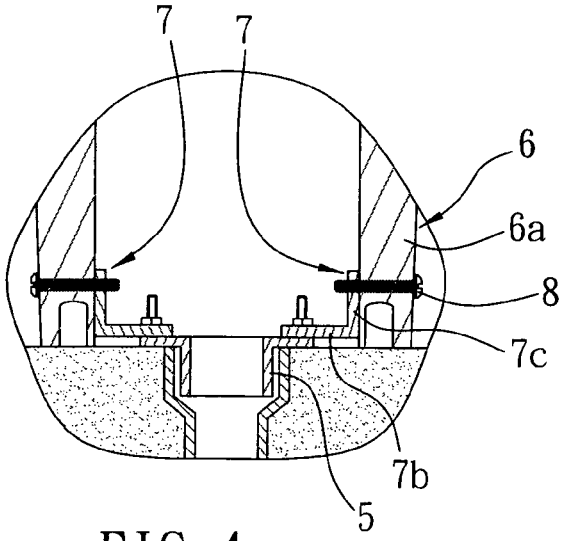
FIG. 4 Prior Art
FIG. 4 is a cross sectional view showing the assembly of the conventional mounting assembly for the conventional toilet.
Figure 5:
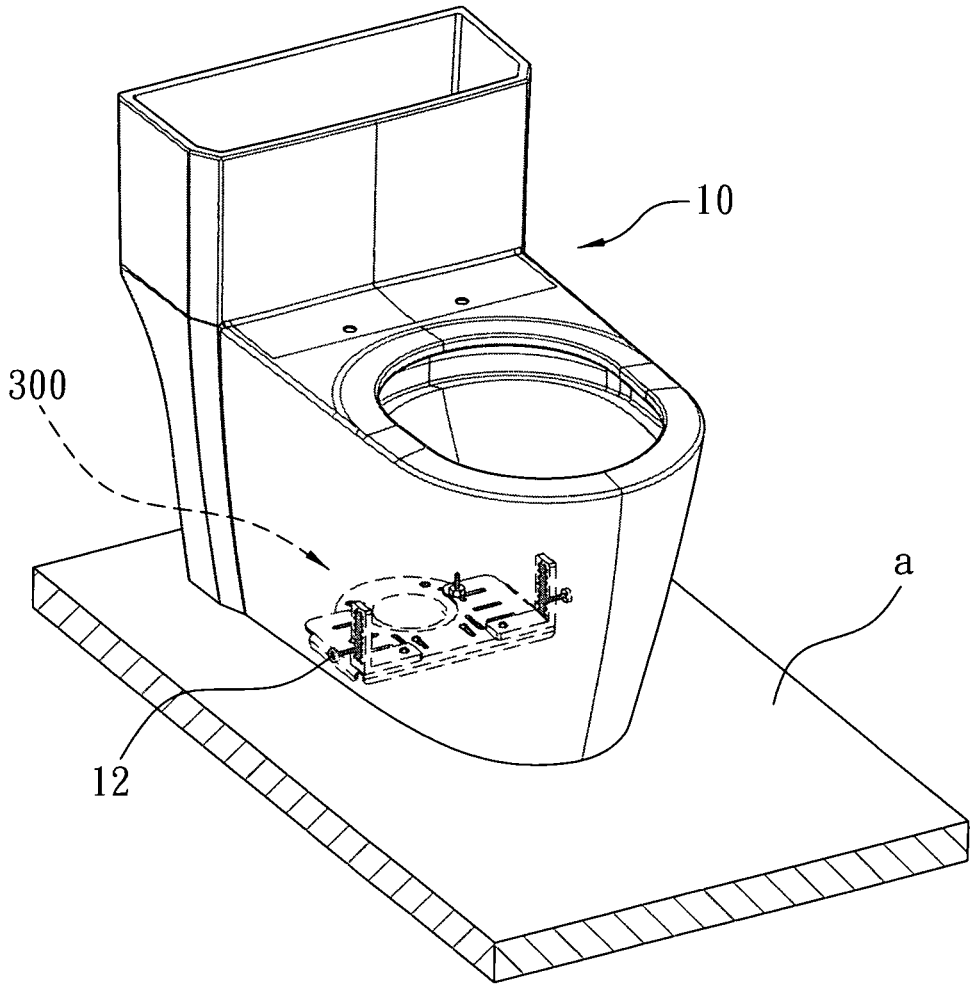
FIG. 5 is a perspective view showing a toilet being fixed on a mounting assembly of a first embodiment of the present invention and a toilet flange.
Figure 6:
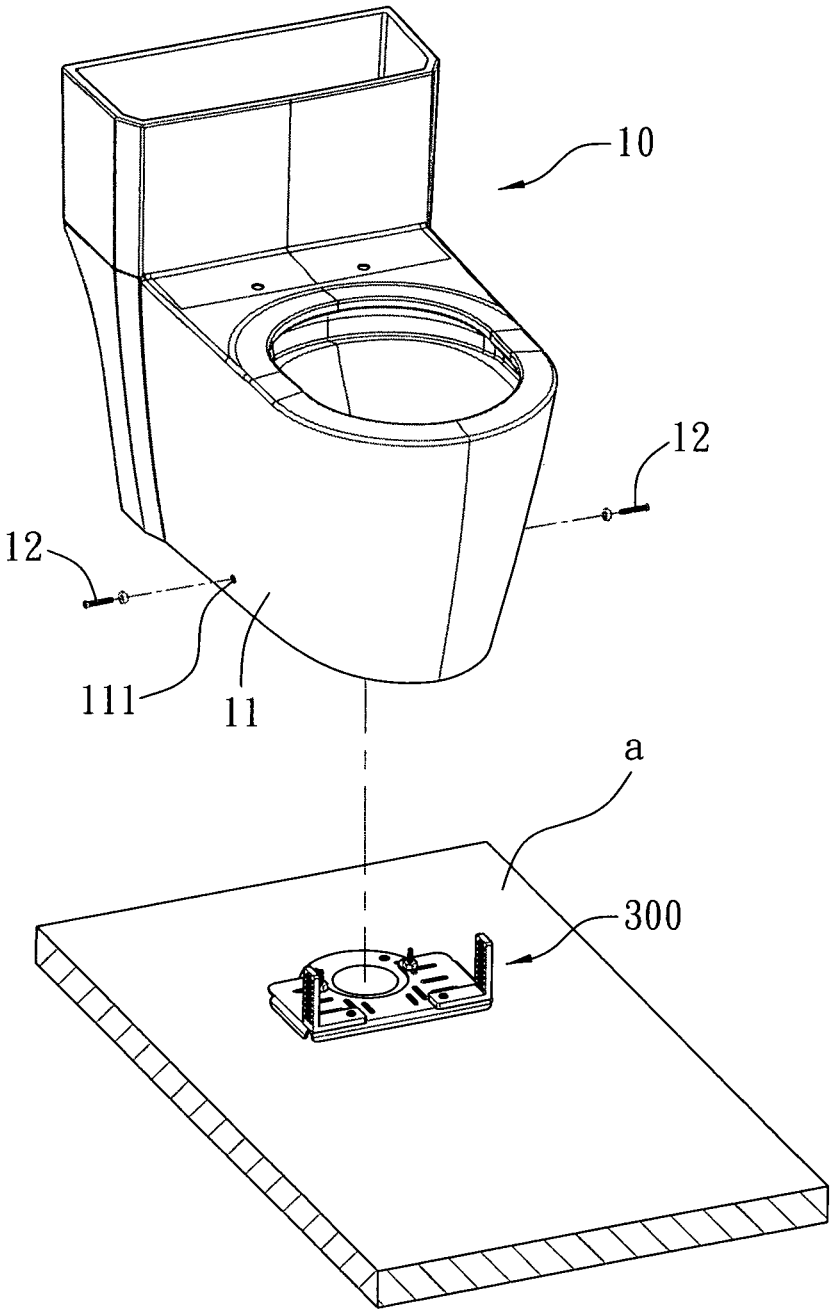
FIG. 6 is a perspective view showing the toilet being fixed on the mounting assembly of the first embodiment of the present invention and the toilet flange.
Figure 7:
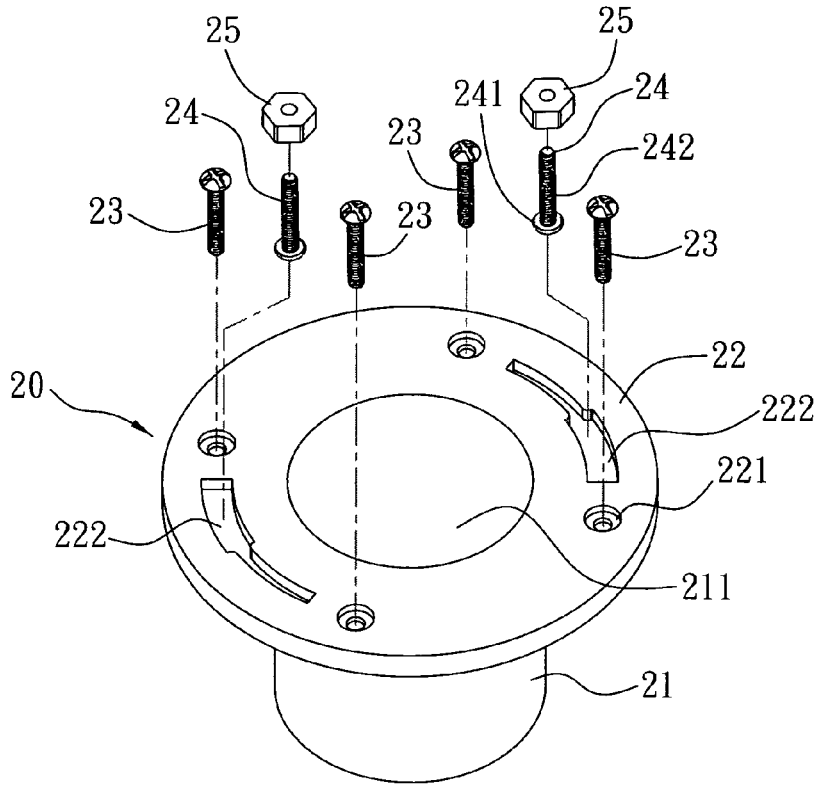
FIG. 7 is a perspective view showing the exploded components of the toilet flange for matching with the mounting assembly of the first embodiment of the present invention.
Figure 8:
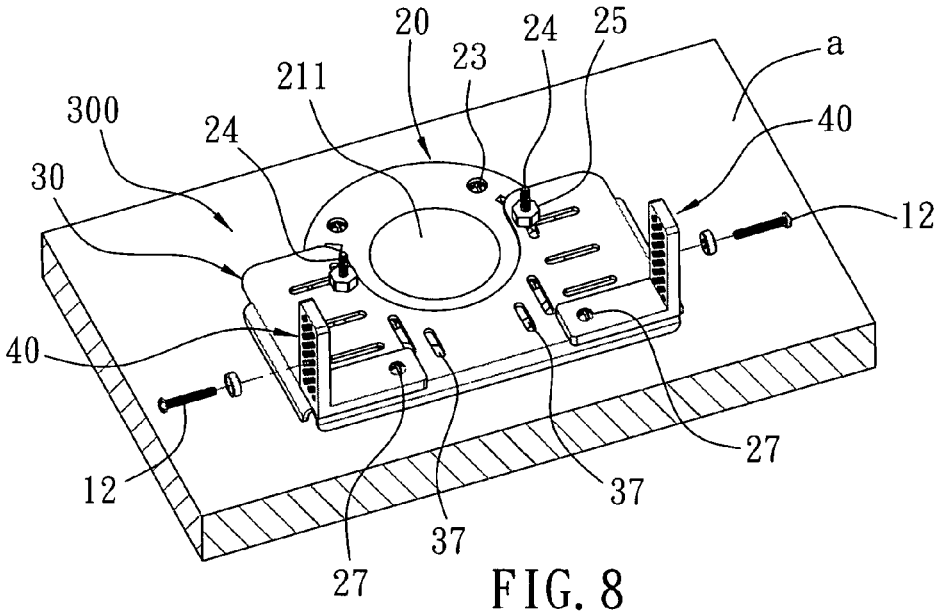
FIG. 8 is a perspective view showing the assembly of the mounting assembly of the first embodiment of the present invention, the toilet flange, and a floor and the toilet flange.

Referring further to FIGS. 5, 6, and 8, a mounting assembly according to a first embodiment of the present invention is used to fix a toilet 10 on a toilet flange 20. The toilet 10 includes two longitudinal fences 11 defined on two sides thereof, and each longitudinal fence 11 has a through hole 111 formed thereon so as to insert a first bolt 12. As shown in FIG. 7, the toilet flange 20 includes a tube 21 and a circular rim 22 arranged around a top surface of the tube 21. The circular rim 22 has at least four orifices 221 and at least two arcuate slots 222. Each orifice 221 is served to insert a flange bolt 23, and then the flange bolt 23 is fixed on a floor a of a building. Each arcuate slot 222 is applied to downwardly slide and retain with a head end 241 of a respective one of at least one second bolt 24, and an extension 242 of a respective one second bolt 24 extends out of the each arcuate slot 222 upwardly.

It is to be noted that the tube 21 of the toilet flange 20 and the circular rim 22 are integrally made of metal material or plastic material. In addition, the tube 21 and the circular rim 22 of the toilet flange 20 are made of metal material and plastic material respectively. For example, the tube 21 is made of plastic material typically, and the circular rim 22 is made of metal material. Due to the toilet flange 20 is well-known art, further remarks are omitted.

Figure 9:
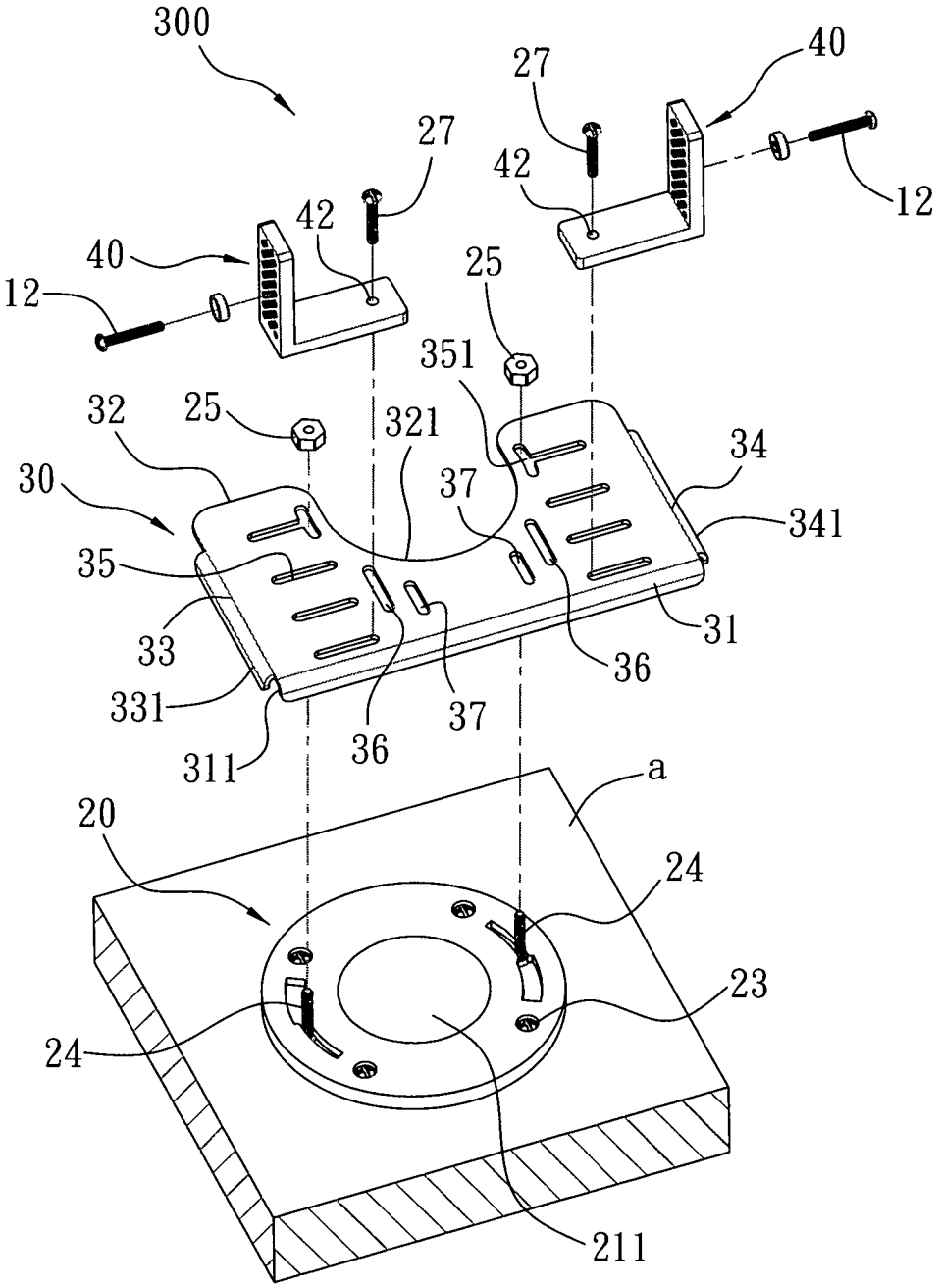
FIG. 9 is a perspective view showing the exploded components of the mounting assembly of the first embodiment of the present invention, the toilet flange, and the floor and the toilet flange.

With reference to FIGS. 8 and 9, a mounting assembly 200 of the first embodiment comprises a plate 30 and two supporting members 40; wherein the plate 30 is an integrally made component and includes a first fringe 31 defined on a front side thereof, a second fringe 32 formed on a rear side thereof, a third fringe 33 arranged on a left side thereof, and a fourth fringe 34 defined on a right side thereof; the first fringe 31 has a first raised portion 311 bending downwardly therefrom so that the plate 30 abuts against the toilet flange 20, the first raised portion 311 contacts with the floor a; the second fringe 32 has a semi-circular groove 321 defined on a middle section thereof so that the plate 30 does not shield an inlet 211 of the tube 21 of the toilet flange 20 by ways of the semi-circular groove 321.

Figure 10:
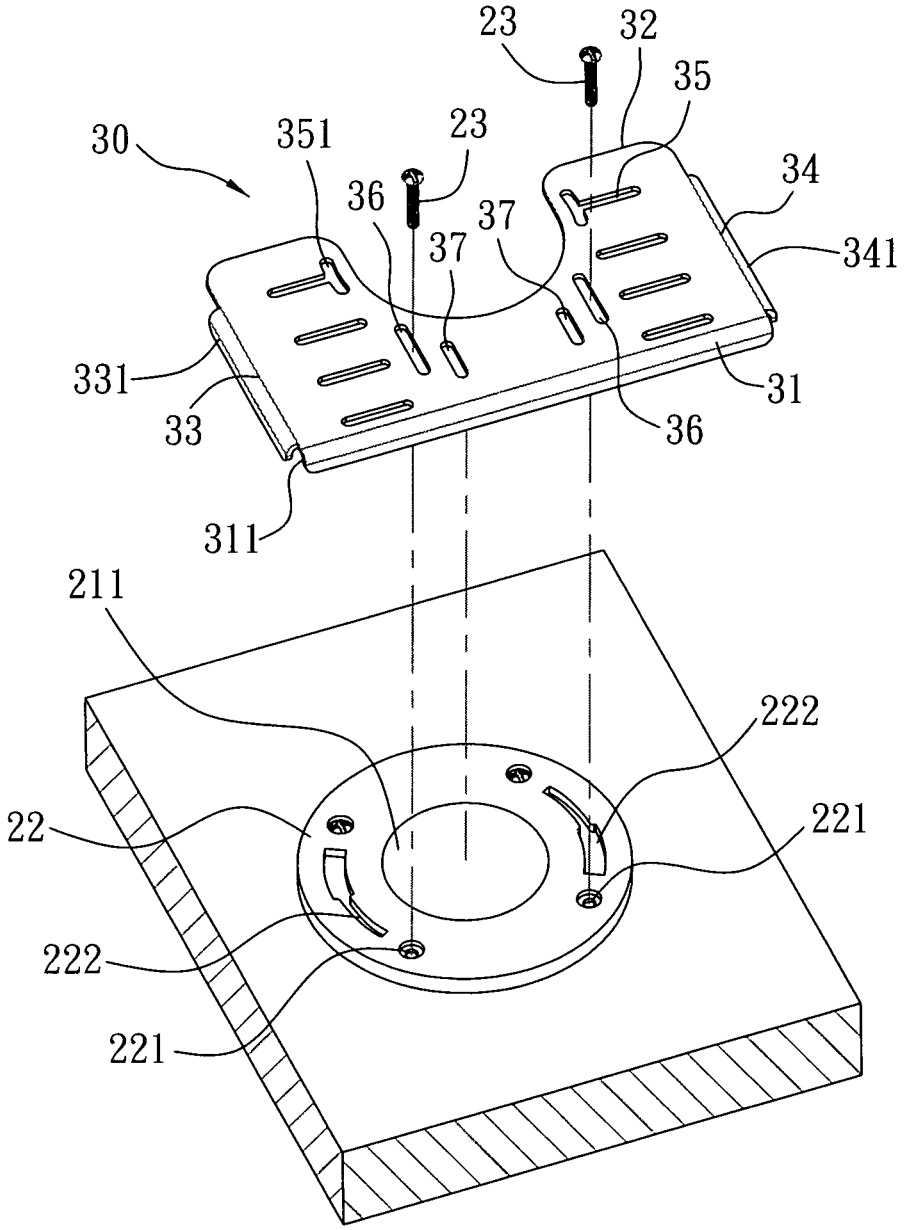
FIG. 10 is another perspective view showing the exploded components of the mounting assembly of the first embodiment of the present invention, the toilet flange, and the floor and the toilet flange.
Figure 11:
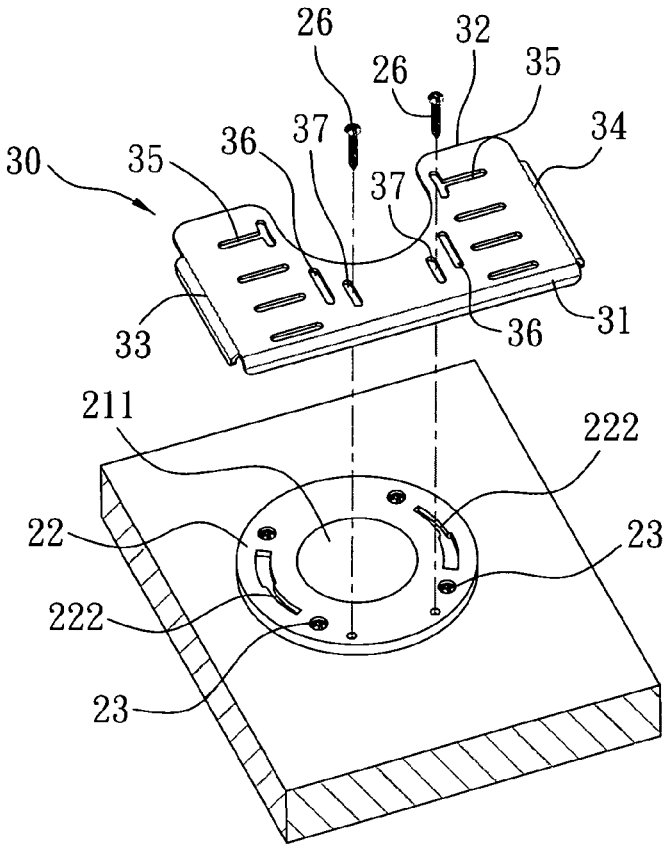
FIG. 11 is also another perspective view showing the exploded components of the mounting assembly of the first embodiment of the present invention, the toilet flange, and the floor and the toilet flange.

As illustrated in FIG. 8, the plate 30 includes a plurality of first adjusting apertures 35 adjacent to the third fringe 33 and the fourth fringe 34, such that the respective one second bolt 24 is alternatively inserted through a respective one first adjusting aperture 35 so as to screw with a respective one of the at least one nut 25, thus fixing the plate 30 on the toilet flange 20. Furthermore, the plate 30 also includes at least one pair of second adjusting aperture 36 and at least one pair of third adjusting aperture 37 defined between the plurality of first adjusting apertures 35 and proximate to the first fringe 31. Each second adjusting aperture 36 and each third adjusting aperture 37 are elongated, and the at least one pair of third adjusting aperture 37 are defined between the at least one pair of second adjusting aperture 36. Referring further to FIG. 10, a distance between the at least one pair of second adjusting aperture 36 is equal to that of two opposite orifices 221 so that two flanged bolts 23 are removed from the two opposite orifices 221 and are locked on the floor a via the at least one pair of second adjusting aperture 36, hence the plate 30 is fixed on the toilet flange 20. As illustrated in FIG. 11, when the toilet flange 20 is made of plastic material, two third bolts 26 are screwed with the circular rim 22 via the at least one pair of third adjusting aperture 37, such that the plate 30 is fixed on the toilet flange 20. Thereby, the plurality of first adjusting apertures 35 match with the at least one second bolt 24 to fix the plate 30 on the toilet flange 20 based on using requirement (i.e., first type of installing operation); or the at least one pair of second adjusting aperture 36 cooperates with the two flanged bolts 23 to fix the plate 30 on the toilet flange 20 (i.e., second type of installing operation); or the at least one pair of third adjusting aperture 37 mates with the two third bolts 26 so as to fix the plate 30 on the toilet flange 20 (i.e., third type of installing operation).

Also, the third fringe 33 has a second raised portion 331 bending downwardly therefrom, and the fourth fringe 34 has a third raised portion 341 bending downwardly therefrom so as to enhance reinforcement.

Referring to FIGS. 8-10, two of the plurality of first adjusting apertures 35 adjacent to the second fringe 32 have two arcuate openings 351 communicating therewith so as to obtain a wider space to insert and screw the at least one second bolt 24 of the toilet flange 20.

Figure 12:
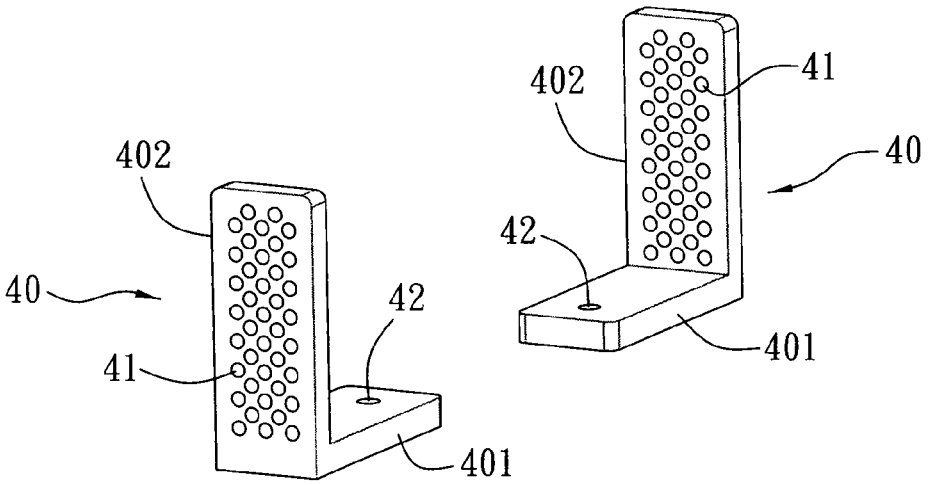
FIG. 12 is a perspective view showing the assembly of two supporting members of the mounting assembly of the first embodiment of the present invention.

As shown in FIGS. 9 and 12, the two supporting members 40 are symmetrically connected with the third fringe 33 and the fourth fringe 34, and each supporting member 40 has a plurality of first eyelets 41 so that the first bolt 12 inserts through the through hole 111 of the each longitudinal fence 11 to screw with one of the plurality of first eyelets 41, hence the toilet 10 is fixed on the toilet flange 20 via the mounting assembly 300.

The each supporting member 40 is formed in a L shape and has a horizontal extending portion 401 and a vertical extending portion 402; the horizontal extending portion 401 has a second eyelet 42 formed thereon so as to insert a fourth bolt 27, and then the fourth bolt 27 screws with the respective one first adjusting aperture 35 of the plate 30, thus positioning the each supporting member 40 on the plate 30.

A height of the first raised portion 311 matches with that of the circular rim 22 which upwardly extends out of the floor a, such that after the plate 30 screws with the toilet flange 20, the first raised portion 311 contacts with the floor a so as support the each supporting member 40 securely.

The plurality of first adjusting apertures 35, the at least one pair of second adjusting aperture 36, and the at least one pair of third adjusting aperture 37 of the plate 30 are used to provide three types of installing operation when fixing the plate 30 on the toilet flange 20. For example, when the toilet flange 20 is made of metal material, a user inserts the respective one second bolt 24 on the each arcuate slot 222 through the respective one first adjusting aperture 35 and then screws the respective one second bolt 24 with the respective one of the at least one nut 25, thus fixing the plate 30. Alternatively, the user inserts the flange bolt 23 on the each orifice 221 through the each second adjusting aperture 36 so as to fix the plate 30 quickly and easily. If the toilet flange 20 is made of plastic material, the users inserts each two third bolt 26 through the each third adjusting aperture 37 so as to fix the plate 30. It is to be noted that the each third bolt 26 is a self-tapping screw, so a pore is drilled on the circular rim 22 of the toilet flange 20 so that the self-tapping screws with the pore. Thereby, the mounting assembly of the present invention provides various installing operation according to using requirement.

Because the plate 30 is not located at a central portion of the toilet flange 20, so it is forwardly or backwardly fixed on the toilet flange 20 based on a varying position of an outlet of each toilet 10. Also, the each supporting member 40 alternatively matches with the each second adjusting aperture 36 so as to adjust an offset distance of the each supporting member 40 relative to the toilet flange 20. In addition, the first bolt 12 of the toilet 10 alternatively matches with one of the plurality of first eyelets 41 of so that a connecting position of the each supporting member 40 and the toilet 10 is adjusted to a central position of the toilet 40, such that the user sits on the toilet securely and conformably.

Figure 13:
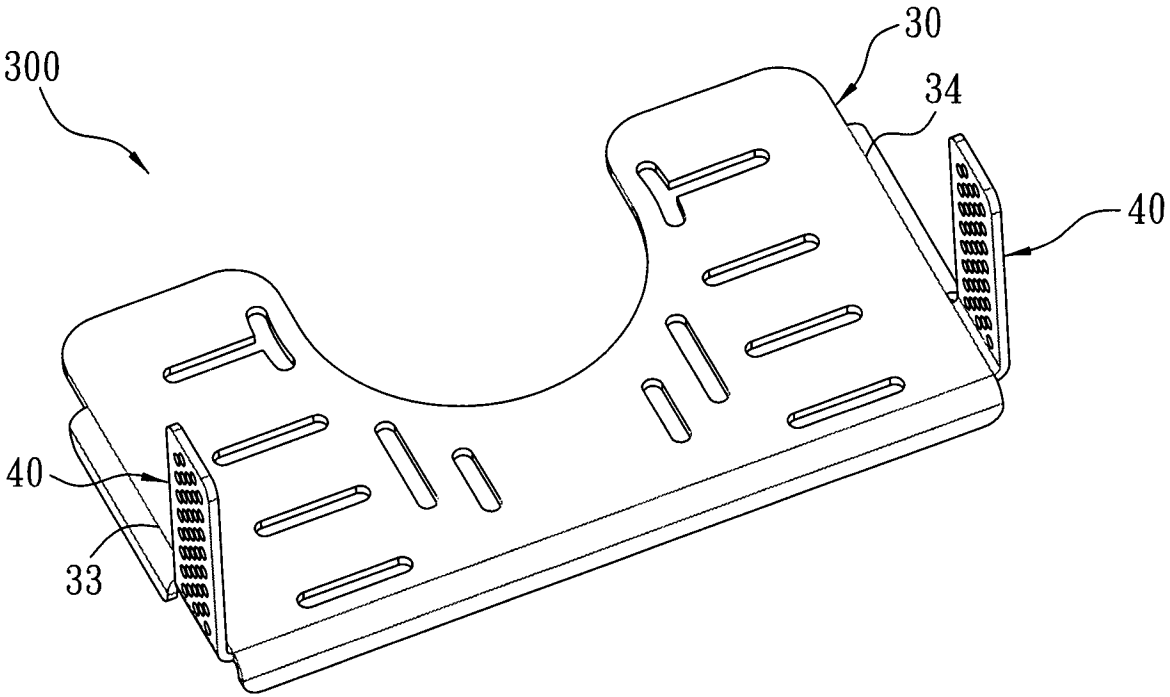
FIG. 13 is a perspective view showing the assembly of a mounting assembly for a toilet according a second embodiment of the present invention.

With reference to FIG. 13, a difference of a mounting assembly 300 of a second embodiment from that of the first embodiment comprises two supporting members 40 integrally formed and upwardly bent from the third fringe 33 and the fourth fringe 34 of the plate 30 so as to eliminate an installing operation of the two supporting members 40. However, a width between the two supporting members 40 cannot be adjusted, so a toilet with a large size between the two longitudinal fence 11 cannot be installed.

Figure 14:
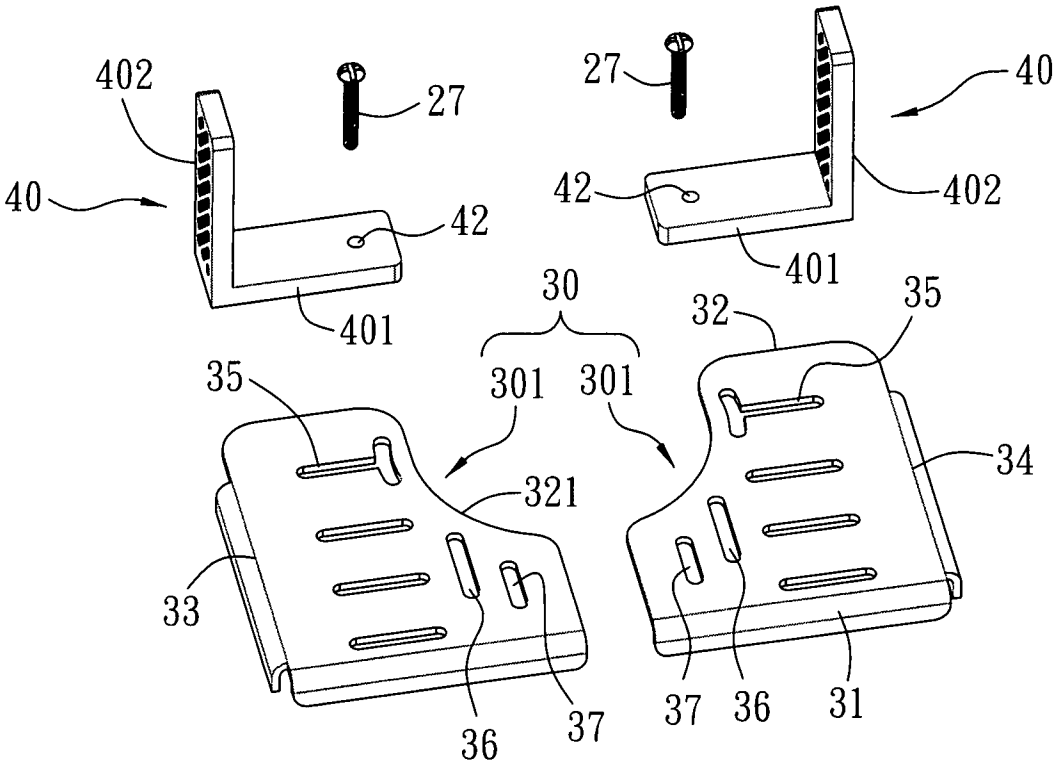
FIG. 14 is a perspective view showing the exploded components of a mounting assembly for a toilet according a third embodiment of the present invention.
Figure 15:
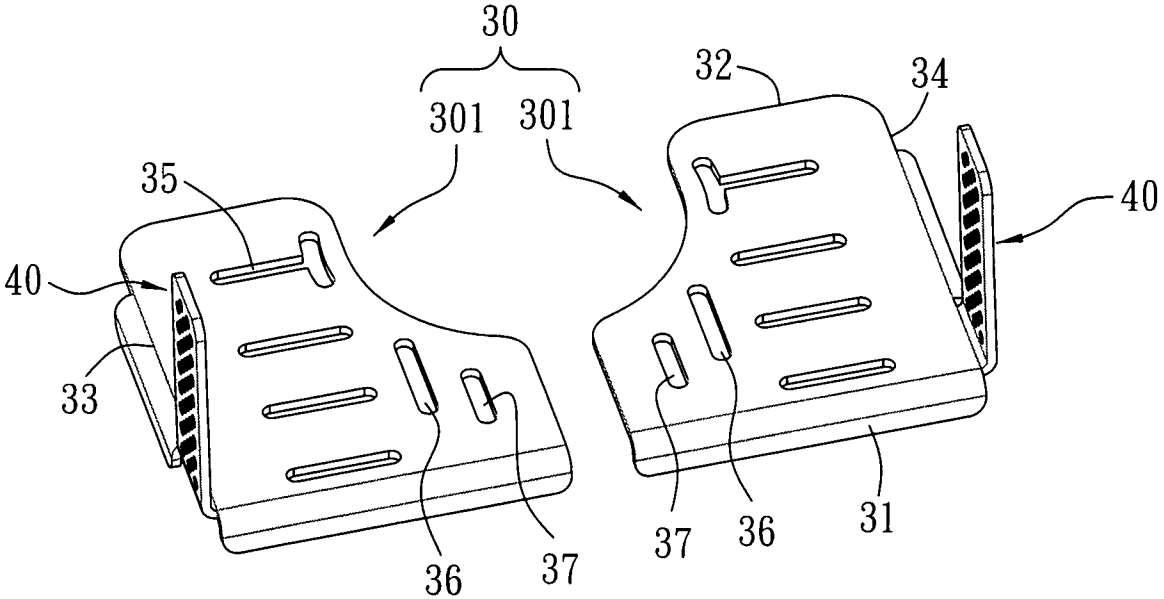
FIG. 15 is a perspective view showing the assembly of a mounting assembly for a toilet according a fourth embodiment of the present invention.

FIG. 14 is a perspective view showing the exploded components of a mounting assembly for a toilet according a third embodiment of the present invention. FIG. 15 is a perspective view showing the assembly of a mounting assembly for a toilet according a fourth embodiment of the present invention. Nevertheless, a plate 30 of the third embodiment and the fourth embodiment are not an integrally made component and are comprises of two symmetrically separated parts 301, wherein a connecting portion of the two separated parts 301 passes through a central portion of the semi-circular groove 321 of the plate 30 so that each separated part 301 has plural first adjusting apertures 35, a second adjusting aperture 36, and a third adjusting aperture 37.

Preferably, the mounting assembly 300 contains four first adjusting apertures 35 defined on the third fringe 33 and the fourth fringe 34 respectively, one pair of second adjusting aperture 36, and one pair of third adjusting aperture 37. However, a number of the first adjusting aperture 35, the second adjusting aperture 36, and the third adjusting aperture 37 changes according to different toilet flange.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A mounting assembly for fixing a toilet on a toilet flange; the toilet including two longitudinal fences, each of the two longitudinal fences being defined on opposite sides of the toilet, and having a through hole for receiving one of two first bolts; the toilet flange including a tube and a circular rim arranged around a top surface of the tube; the circular rim having at least four orifices and at least two arcuate slots; each of the at least four orifices receiving one of at least four flange bolts, the at least four flange bolts being fixed on a floor of a building; the toilet flange rotates/slides about one of at least two second bolts, a head of each second bolt being retained by each of the at least two arcuate slots, and an extension of each second bolt extending out of each arcuate slot upwardly; the mounting assembly comprising:

a plate including a first fringe defined on a front side thereof, a second fringe formed on a rear side thereof, a third fringe defined on a left side thereof, and a fourth fringe defined on a right side thereof; the first fringe having a first raised portion extending downwardly from the first fringe, such that when the plate abuts against the toilet flange, the first raised portion contacts with the floor; the second fringe having semi-circular groove defined on a middle section thereof, such that the plate does not interfere with an inlet of the tube of the toilet flange; the plate including at least four first adjusting apertures adjacent to the third fringe and receiving at least one of the two second bolts therein, and at least four first adjusting apertures adjacent to the fourth fringe and receiving at least one of the two second bolts therein, each of the at least two second bolts screwing with a nut, thus fixing the plate on the toilet flange;

the plate also including at least one pair of second adjusting apertures, one second adjusting aperture being adjacent to the at least four first adjusting apertures adjacent the third fringe and one second adjusting apertures being adjacent to the at least four first adjusting apertures adjacent the fourth fringe, and the plate further including at least one pair of third adjusting apertures defined between the at least one pair of second adjusting apertures; each of the at least one pair of second adjusting apertures and each of the at least one pair of third adjusting apertures being elongated; a distance between the at least one pair of second adjusting apertures being equal to that of two opposed orifices of the at least four orifices so that two of the at least four flange bolts are removed from the two opposed orifices and are locked on the floor via the at least one pair of second adjusting apertures, hence the plate is fixed on the toilet flange;

two supporting members, one of which is located on the third fringe, and the other of which is located on the fourth fringe, and each of the two supporting members having a plurality of first eyelets, such that each first bolt inserts through the through hole of each longitudinal fence to screw with one of the plurality of first eyelets, hence the toilet is fixed on the toilet flange via the mounting assembly;

wherein one of the at least four first adjusting apertures adjacent to the third fringe and one of the at least four first adjusting apertures adjacent to the fourth fringe is located adjacent the second fringe and has an arcuate openings which is connected to the one first adjusting apertures.

2. The mounting assembly as claimed in claim 1, wherein each supporting member is formed in a L shape and has a horizontal extending portion and a vertical extending portion; the horizontal extending portion of each supporting member has a second eyelet formed thereon, such that each of the two flange bolts is inserted through the second eyelet of the horizontal extending portion of each supporting member and another of the at least four first adjusting apertures adjacent to the third fringe and another of the at least four first adjusting apertures adjacent to the fourth fringe, the another apertures being adjacent to the first fringe to screw with each of the two opposed orifices of the toilet flange, thus fixing each supporting member and the plate on the toilet flange.

3. The mounting assembly as claimed in claim 1, wherein the two supporting members are integrally formed and upwardly bent from the third fringe and the fourth fringe of the plate.

4. The mounting assembly as claimed in claim 1, wherein the plate is comprised of two joining parts, and each joining part has plural first adjusting apertures, a second adjusting aperture, and a third adjusting aperture.

5. The mounting assembly as claimed in claim 4, wherein each supporting member is formed in an L shape and has a horizontal extending portion and a vertical extending portion and vertical extending portion; the horizontal extending portion of each supporting member has a second eyelet formed thereon, such that each of two fourth bolts is inserted through the second eyelet of the horizontal extending portion of each supporting member and another of the at least four first adjusting apertures adjacent to the third fringe and another of the at least four first adjusting apertures adjacent to the fourth fringe, the another apertures being adjacent to the first fringe, thus positioning each supporting member on the plate.

6. The mounting assembly as claimed in claim 5, wherein each supporting member extends upwardly from the third fringe or the fourth fringe of the plate.

7. The mounting assembly as claimed in claim 1, wherein the mounting assembly contains four first adjusting apertures defined on each of the third fringe and the fourth fringe.

8. The mounting assembly as claimed in claim 1, wherein the third fringe has a second raised portion extending downwardly from the third fringe, and the fourth fringe has a third raised portion extending downwardly from the fourth fringe.

* * * * *